US010371396B2

(12) United States Patent
Chi et al.

(10) Patent No.: US 10,371,396 B2
(45) Date of Patent: Aug. 6, 2019

(54) AIR CONDITIONER HEAT-RADIATING CIRCULATION SYSTEM

(71) Applicant: QINGDAO HISENSE HITACHI AIR-CONDITIONING SYSTEMS CO., LTD., Qingdao (CN)

(72) Inventors: Wugong Chi, Qingdao (CN); Rui Cao, Qingdao (CN); Wenqiang Zhang, Qingdao (CN); Yajun Li, Qingdao (CN); Chengjun He, Qingdao (CN); Wentao Lin, Qingdao (CN); Leilei Ge, Qingdao (CN)

(73) Assignee: QINGDAO HISENSE HITACHI AIR-CONDITIONING SYSTEMS CO., LTD., Shandong (CN)

( * ) Notice: Subject to any disclaimer, the term of this patent is extended or adjusted under 35 U.S.C. 154(b) by 316 days.

(21) Appl. No.: 14/800,545

(22) Filed: Jul. 15, 2015

(65) Prior Publication Data

US 2015/0316278 A1 Nov. 5, 2015

Related U.S. Application Data

(63) Continuation of application No. PCT/CN2014/070038, filed on Jan. 2, 2014.

(30) Foreign Application Priority Data

Mar. 22, 2013 (CN) ..... 2013 1 0092624

(51) Int. Cl.
*F28B 1/02* (2006.01)
*F25B 5/04* (2006.01)
(Continued)

(52) U.S. Cl.
CPC ..... *F24F 5/001* (2013.01); *F24F 5/0089* (2013.01); *F25B 5/04* (2013.01); *F25B 41/046* (2013.01); *F28F 1/02* (2013.01); *F28F 2260/02* (2013.01)

(58) Field of Classification Search
CPC ..... F24F 5/001; F24F 5/0089; F24F 11/0012; F24F 11/0076; F24F 11/0082; F24F 1/24;
(Continued)

(56) References Cited

U.S. PATENT DOCUMENTS 2,655,793 A * 10/1953 Shoemaker ..... F24F 5/001 62/149
5,123,255 A * 6/1992 Ohizumi ..... F24F 11/0009 165/205
(Continued)

FOREIGN PATENT DOCUMENTS

CN 101498469 A 8/2009
CN 102724853 A 10/2012
(Continued)

OTHER PUBLICATIONS

Partial English Machine Translation: CN 102724853: Accessed Jun. 2017.*
(Continued)

*Primary Examiner* — Jianying C Atkisson
*Assistant Examiner* — Tavia Sullens
(74) *Attorney, Agent, or Firm* — J.C. Patents

(57) ABSTRACT

Disclosed is an air conditioner heat-radiating circulation system, comprising a compressor (1). A discharge pipe of the compressor (1) is connected to a four-way reversing valve (2), which is connected to an outdoor heat exchanger (4) that is connected to an indoor heat exchanger (10) via an electronic expansion valve (11), the indoor heat exchanger (10) is connected to a stop value (3) that is connected to a
(Continued)

gas suction pipe of the compressor (1) via the four-way reversing valve (2), the gas suction pipe is provided with a refrigerating circulation branch, which includes a branch electromagnetic valve (5) that is connected to a flat tube micro-channel aluminum-based radiator (6) with a temperature sensor (8); the gas suction pipe is further provided with a gas suction electromagnetic valve (7) that is connected in parallel to the branch electromagnetic valve (5).

17 Claims, 3 Drawing Sheets

(51) Int. Cl.

| | |
|---|---|
| ***F25B 41/04*** | (2006.01) |
| ***F24F 1/24*** | (2011.01) |
| ***F24F 5/00*** | (2006.01) |
| *F28F 1/02* | (2006.01) |

(58) Field of Classification Search
CPC . F24F 1/08; F24F 1/06; F28F 2260/02; F25B 5/04; F25B 2313/0234; F25B 2313/02341; F25B 2400/0409; F25B 41/04; F25B 41/043; F25B 41/046
USPC ..... 62/198
See application file for complete search history.

(56) References Cited

U.S. PATENT DOCUMENTS

| | | | | |
|---|---|---|---|---|
| 9,822,994 | B2 * | 11/2017 | Yanachi | F25B 13/00 |
| 2010/0251758 | A1 * | 10/2010 | Yabu | F24F 3/1411 62/476 |
| 2011/0209490 | A1 * | 9/2011 | Mijanovic | F24F 11/008 62/190 |
| 2012/0312046 | A1 * | 12/2012 | Kim | F24F 1/24 62/259.2 |

FOREIGN PATENT DOCUMENTS

| | | | |
|---|---|---|---|
| CN | 103162475 | A | 6/2013 |
| CN | 203240844 | U | 10/2013 |
| CN | 103162475 | B | 4/2015 |
| JP | 2013-024537 | | 2/2013 |

OTHER PUBLICATIONS

International Search Report of corresponding International PCT Application No. PCT/CN2014/070038, dated Feb. 27, 2014.
Chinese First Examination Report of corresponding China patent application No. 201310092624.6, dated Apr. 9, 2014.

* cited by examiner

AIR CONDITIONER HEAT-RADIATING CIRCULATION SYSTEM

CROSS-REFERENCE TO RELATED APPLICATIONS

This application is a continuation of the international application No. PCT/CN2014/070038 filed on Jan. 2, 2014, which claims the priority benefits of Chinese application No. 201310092624.6 filed on Mar. 22, 2013. The contents of those prior applications are hereby incorporated by reference in their entireties.

FIELD OF THE TECHNOLOGY

The present invention relates to an air conditioner circulation system, and more particularly, to a heat-radiating circulation system for an air conditioning unit.

BACKGROUND

Currently, a conventional air conditioner heat-radiating system adopts a serrated aluminum-based radiator that is tightly connected to a power module, a variable-frequency compressor driving module, and a variable-frequency blower driving module, of an air conditioner outdoor unit, and thus heat is absorbed from the power module, the variable-frequency compressor driving module and the variable-frequency blower driving module, of the air conditioner outdoor unit via the serrated aluminum-based radiator fin and dissipated into the surrounding air by means of air convection and a little natural radiation.

The above air conditioner heat-radiating system has the following two disadvantages and shortcomings:

First, heat-radiating effect of the air conditioner is unsatisfactory when it is used for cooling in summer: especially in some areas, such as East China and South China, outdoor temperatures in these areas are high in summer and air conditioners are used frequently, so that the power module, the variable-frequency compressor driving module and the variable-frequency blower driving module, of the air conditioner outdoor unit, each emits a large amount of heat, but due to a high outdoor temperature, the temperature of the serrated aluminum-based radiator fin cannot be reduced to below the ambient temperature (because the ambient temperature near the air conditioner outdoor unit is generally 40° C.-50° C.) by air convection, which leads to that the heat produced by the power module, the variable-frequency compressor driving module and the variable-frequency blower driving module, of the air conditioner outdoor unit, during their operation cannot be radiated sufficiently, and thereby oftentimes the power module, the variable-frequency compressor driving module and the variable-frequency blower driving module, of the air conditioner outdoor unit cannot operate normally with high efficiency, and it even leads to a running fault of the air conditioner in serious situation, reducing working stability and service life of the air conditioner;

Second, heat produced by the air conditioner cannot be recycled when it is used for heating in winter: since the serrated aluminum-based radiator circulation system cannot recycle the heat emitted from the power module, the variable-frequency compressor driving module and the variable-frequency blower driving module, of the air conditioner outdoor unit, the heat is wasted to a certain extent.

China patent application No. 201210217361.2 titled "Flat Tube Micro-channel Aluminum-based Radiator" provides a flat tube micro-channel aluminum-based radiator, which includes an aluminum plate and an insulation layer fixed on an electric box of an air conditioner, and a flat tube micro-channel heat exchange tube, of a hollow pipe structure, is disposed between the aluminum plate and the insulation layer, and is provided with heat exchange grilles within cavities thereof. The inventive flat tube micro-channel aluminum-based radiator has a reasonable structural design, reducing the volume of the radiator while increasing heat-radiating area, effectively controlling and recycling heat, and improving the heat-radiating efficiency when the air conditioner system is in operation.

SUMMARY

Based on the above disadvantages in the prior art, the technical problem to be solved by the present invention is to provide an air conditioner heat-radiating circulation system, using a flat tube micro-channel aluminum-based radiator and also a low-temperature and low-pressure refrigerant gas in the air conditioner system to dissipate heat from a power module, a variable-frequency compressor driving module and a variable-frequency blower driving module, of an air conditioner outdoor unit. In summer, the air conditioner heat-radiating circulation system is not affected by the outdoor temperature and can enhance heat-radiating efficiency; and in winter, the heat emitted from the power module, the variable-frequency compressor driving module and the variable-frequency blower driving module, of the air conditioner outdoor unit can be recycled, to improve the suction superheat degree of the compressor in the air conditioner and thus enhance heating effect of the air conditioning unit; it is possible to ensure the operation stability of the air conditioning unit and extend its service life.

In order to solve the above problems, the present invention provides an air conditioner heat-radiating circulation system, which includes a compressor, a discharge pipe of the compressor is connected to a four-way reversing valve, the four-way reversing valve is connected to an outdoor heat exchanger, the outdoor heat exchanger is connected to an indoor heat exchanger via an electronic expansion valve, the indoor heat exchanger is connected to a stop value, the stop value is connected to a gas suction pipe of the compressor via the four-way reversing valve, the gas suction pipe of the compressor is connected to the compressor via a gas-liquid separator, the gas suction pipe is provided with a refrigerating circulation branch, the refrigerating circulation branch includes a branch electromagnetic valve, the branch electromagnetic valve is connected to a flat tube micro-channel aluminum-based radiator, and the flat tube micro-channel aluminum-based radiator is provided with a temperature sensor; the gas suction pipe is further provided with a gas suction electromagnetic valve; and the gas suction electromagnetic valve is connected in parallel to the branch electromagnetic valve.

In the above air conditioner heat-radiating circulation system, the flat tube micro-channel aluminum-based radiator is tightly connected to a power module, a variable-frequency compressor driving module and a variable-frequency blower driving module, of an air conditioner outdoor unit.

In the above air conditioner heat-radiating circulation system, the temperature sensor controls opening degrees of the branch electromagnetic valve and the gas suction electromagnetic valve.

In order to solve the above technical problems, the present invention further provides an air conditioner heat-radiating circulation system, which includes a compressor, a refrigerating and heating circulation pipeline, the compressor outputs a refrigerant gas via a discharge pipe, the refrigerant gas flows back to the compressor via a gas suction pipe after circulating in the refrigerating and heating circulation pipeline, wherein the gas suction pipe is provided with a refrigerating circulation branch that includes a branch electromagnetic valve and a flat tube micro-channel aluminum-based radiator in series and also a gas suction electromagnetic valve provided on the gas suction pipe, an input terminal of the gas suction electromagnetic valve is connected to an input terminal of the branch electromagnetic valve, and an output terminal of the flat tube micro-channel aluminum-based radiator is connected to an output terminal of the gas suction electromagnetic valve.

The present invention makes improvements to an air conditioner outdoor unit circulation system, specifically, to add a refrigerating circulation branch on the gas suction pipe of the compressor, the branch includes a branch electromagnetic valve, a flat tube micro-channel aluminum-based radiator, and a temperature sensor installed on the flat tube micro-channel aluminum-based radiator, and to add a gas suction electromagnetic valve on the gas suction pipe of the air conditioner. The added refrigerating circulation branch is in parallel to the gas suction pipe and utilizes the temperature sensor to control opening degrees of the branch electromagnetic valve and the gas suction electromagnetic valve, thereby controlling the flow of the refrigerant flowing through the flat tube micro-channel aluminum-based radiator, to make the low-temperature and low-pressure refrigerant gas absorb heat from the flat tube micro-channel aluminum-based radiator and always keep the temperature of the flat tube micro-channel aluminum-based radiator being lower than the external ambient temperature by 5° C., so that the heat emitted from the power module, the variable-frequency compressor driving module and the variable-frequency blower driving module, of the air conditioner can be absorbed sufficiently, and condensed water will not be generated on surfaces of these modules.

The present invention has the following advantages and technical effects:

1. The present invention provides a flat tube micro-channel aluminum-based radiator heat-radiating circulation system, which utilizes low-temperature (5-12° C.) and low-pressure refrigerant gas of a direct-expansion air conditioner to dissipate the heat from a power module, a variable-frequency compressor driving module, and a variable-frequency blower driving module of the air conditioner. When outdoor air has a high temperature in summer, it can be ensured that the heat-radiating effects of the power module, the variable-frequency compressor driving module and the variable-frequency blower driving module are not influenced by the outdoor temperature, and the power module, the variable-frequency compressor driving module, and the variable-frequency blower driving module are always kept within a proper operating temperature range, thus maintaining an optimal state of operating temperature.

2. In winter the heat-radiating circulation system of the present invention can recycle heat emitted from the power module, the variable-frequency compressor driving module and the variable-frequency blower driving module of the air conditioner, to enhance suction superheat degree of the compressor in the air conditioner, and thus enhance the heating effect of the air conditioning unit.

3. The heat-radiating circulation system of the present invention has a small volume and thus can be easily installed; it can be controlled easily when operating, has adjustable cooling temperature and can evenly and stably dissipate heat, thereby having excellent heat-radiating effect.

4. The present invention can ensure stable operation of the air conditioning unit and extend service life of the air conditioning unit.

Figure 1:
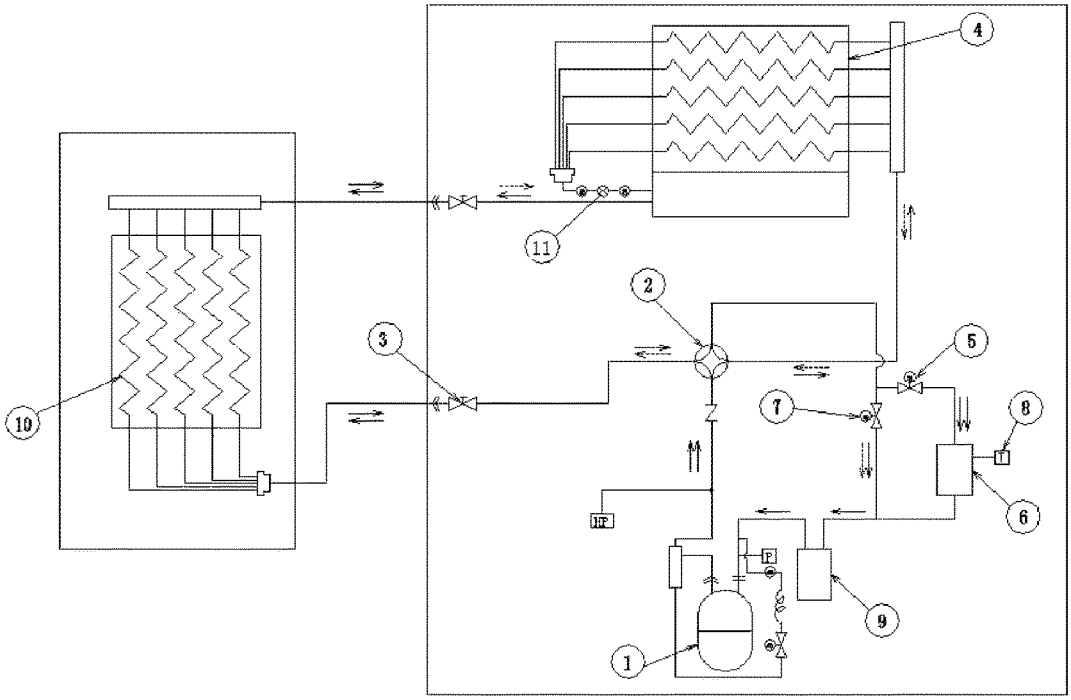
FIG. 1 is a schematic view of a flat tube micro-channel aluminum-based radiator system according to the present invention.
Figure 2:
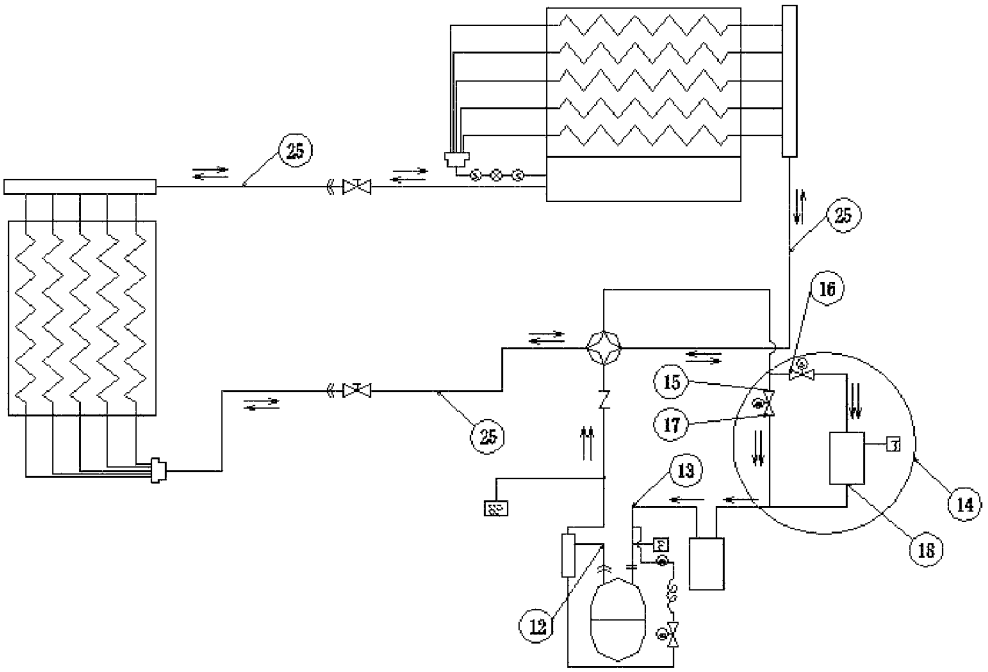
FIG. 2 is a schematic view of an air conditioner heat-radiating circulation system according to the present invention.
Figure 3:
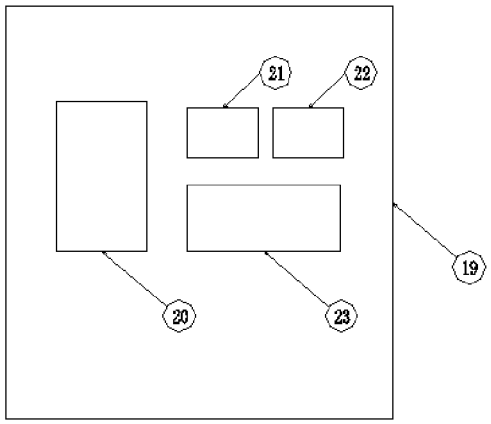
FIG. 3 is a schematic view of an electric box of an air conditioner according to the present invention.
Figure 4:
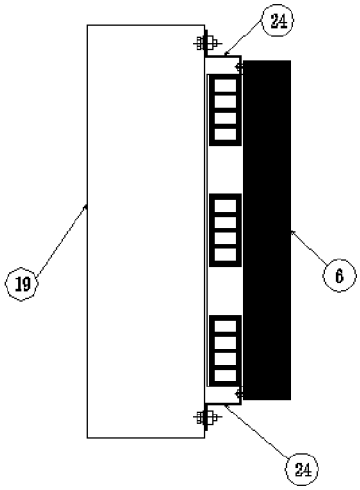
FIG. 4 shows the connection between an electric box of air conditioner and the flat tube micro-channel aluminum-based radiator.

1—compressor, 2—four-way reversing valve, 3—stop value, 4—outdoor heat exchanger, 5—branch electromagnetic valve, 6—flat tube micro-channel aluminum-based radiator, 7—gas suction electromagnetic valve, 8—temperature sensor, 9—gas-liquid separator, 10—indoor heat exchanger, 11—electronic expansion valve, 12—discharge pipe (discharge pipe of compressor), 13—gas suction pipe (gas suction pipe of compressor), 14—refrigerating circulation branch, 15—input terminal (input terminal of gas suction electromagnetic valve), 16—input terminal (input terminal of branch electromagnetic valve), 17—output terminal (output terminal of gas suction electromagnetic valve), 18—output terminal (output terminal of flat tube micro-channel aluminum-based radiator), 19—electric box (electric box of air conditioner), 20—main control panel, 21—power module, 22—variable-frequency compressor driving module, 23—variable-frequency blower driving module, 24—fixing bracket, and 25—refrigerating and heating circulation pipeline.

DETAILED DESCRIPTION

In an embodiment of the present invention, there is provided an air conditioner heat-radiating circulation system, which includes a compressor 1, a discharge pipe 12 of the compressor 1 is connected to a four-way reversing valve 2, the four-way reversing valve 2 is connected to an outdoor heat exchanger 4, the outdoor heat exchanger 4 is connected to an indoor heat exchanger 10 via an electronic expansion valve 11, the indoor heat exchanger 10 is connected to a stop value 3, the stop valve 3 is connected to a gas suction pipe of the compressor 1 via the four-way reversing valve 2, the gas suction pipe of the compressor 1 is connected to the compressor 1 via a gas-liquid separator 9, the gas suction pipe is provided with a refrigerating circulation branch 14, the refrigerating circulation branch 14 includes a branch electromagnetic valve 5, the branch electromagnetic valve 5 is connected to a flat tube micro-channel aluminum-based radiator 6, the flat tube micro-channel aluminum-based radiator 6 is provided with a temperature sensor 8; the gas suction pipe is further provided with a gas suction electromagnetic valve 7; and the gas suction electromagnetic valve 7 is connected in parallel to the branch electromagnetic valve 5.

The flat tube micro-channel aluminum-based radiator 6 is tightly connected to a power module 21, a variable-frequency compressor driving module 22 and a variable-frequency blower driving module 23, of an air conditioner outdoor unit.

The temperature sensor 8 controls opening degrees of the branch electromagnetic valve 5 and the gas suction electromagnetic valve 7.

The flat tube micro-channel aluminum-based radiator 6 is fixed on an electric box 19 of the air conditioner via a fixing bracket 24, and a rubber-plastic thermal insulation material with a thickness of 8 mm is provided between the flat tube micro-channel aluminum-based radiator and the electric box 19, having a function of heat preservation and heat insulation, so that the refrigerant with a low temperature can absorb all or most of the heat emitted from the power module 21, the variable-frequency compressor driving module 22 and the variable-frequency blower driving module 23, of the air conditioner and meanwhile the flat tube micro-channel aluminum-based radiator can be protected from forming condensed water on surface thereof.

In summer, refrigerating output of the air conditioner itself is utilized to dissipate heat from the flat tube micro-channel aluminum-based radiator, that is, refrigerating output of the air conditioner itself is consumed to dissipate heat from the power module 21, the variable-frequency compressor driving module 22 and the variable-frequency blower driving module 23 of the air conditioner outdoor unit. Specifically, the refrigerating principle in summer is as follows:

The compressor 1 discharges a high-temperature and high-pressure refrigerant gas to the outdoor heat exchanger 4 via the four-way reversing valve 2, and after dissipating heat, the refrigerant gas becomes a high-temperature and high-pressure refrigerant liquid, which becomes a low-temperature and low-pressure refrigerant liquid by throttling effect of the electronic expansion valve 11 and the low-temperature and low-pressure refrigerant liquid enters the indoor heat exchanger 10 and absorbs heat therein to become a low-temperature and low-pressure refrigerant gas, flowing through the stop value 3 and subsequently the four-way reversing valve 2. Based on a temperature point fed back by the temperature sensor 8, appropriate amount of the low-temperature and low-pressure refrigerant gas is controlled to pass through the branch electromagnetic valve 5 to enter the flat tube micro-channel aluminum-based radiator 6, and then becomes a refrigerant gas having elevated temperature and pressure after absorbing heat therein, to enter the gas-liquid separator 9, another part of the low-temperature and low-pressure refrigerant gas directly enters the gas-liquid separator 9 through the gas suction electromagnetic valve 7, the above two parts of the low-temperature and low-pressure refrigerant gas enter the compressor 1 after mixing. One complete circulation is completed.

In some embodiments, there is provided an air conditioner heat-radiating circulation system, which includes a compressor 1, a discharge pipe 12 of the compressor 1 is connected to a four-way reversing valve 2, the four-way reversing valve 2 is connected to an outdoor heat exchanger 4, the outdoor heat exchanger 4 is connected to an indoor heat exchanger 10 via an electronic expansion valve 11, the indoor heat exchanger 10 is connected to a stop value 3, the stop valve 3 is connected to a gas suction pipe of the compressor 1 via the four-way reversing valve 2, the gas suction pipe of the compressor 1 is connected to the compressor 1 via a gas-liquid separator 9, the gas suction pipe is provided with a refrigerating circulation branch 14, the refrigerating circulation branch 14 includes a branch electromagnetic valve 5, the branch electromagnetic valve 5 is connected to a flat tube micro-channel aluminum-based radiator 6, the flat tube micro-channel aluminum-based radiator 6 is provided with a temperature sensor 8; the gas suction pipe is further provided with a gas suction electromagnetic valve 7; and the gas suction electromagnetic valve 7 is connected in parallel to the branch electromagnetic valve 5.

The flat tube micro-channel aluminum-based radiator 6 is tightly connected to an air conditioner power module 21, a variable-frequency compressor driving module 22 and a variable-frequency blower driving module 23.

The temperature sensor 8 is used to control opening degrees of the branch electromagnetic valve 5 and the gas suction electromagnetic valve 7.

The flat tube micro-channel aluminum-based radiator 6 is fixed on an electric box 19 of the air conditioner via a fixing bracket 24, and a rubber-plastic thermal insulation material with a thickness of 8 mm is provided between the flat tube micro-channel aluminum-based radiator and the electric box 19, to have a function of heat preservation and heat insulation, so that the refrigerant with a low temperature can absorb all or most of the heat emitted from the power module 21, the variable-frequency compressor driving module 22 and the variable-frequency blower driving module 23, of the air conditioner and meanwhile the flat tube micro-channel aluminum-based radiator can be protected from forming condensed water on surface thereof.

In winter, the heat from the flat tube micro-channel aluminum-based radiator is recycled and utilized to enhance suction superheat degree of the air conditioner, so as to increase heating capacity of the air conditioner itself, that is, the heat emitted from the power module 21, the variable-frequency compressor driving module 22 and the variable-frequency blower driving module 23, of the air conditioner, is recycled. Specifically, the heating principle in winter is as follows:

The compressor 1 discharges a high-temperature and high-pressure refrigerant gas to the indoor heat exchanger 10 via the four-way reversing valve 2 and subsequently the stop value 3, and after emitting heat, the refrigerant gas becomes a high-temperature and high-pressure refrigerant liquid, which then becomes a low-temperature and low-pressure refrigerant liquid by throttling effect of the electronic expansion valve 11 and enters the outdoor heat exchanger 4 to become a low-temperature and low-pressure refrigerant gas after absorbing heat therein, subsequently flowing through the four-way reversing valve 2. Based on a temperature point fed back by the temperature sensor 8, appropriate amount of the low-temperature and low-pressure refrigerant gas is controlled to pass through the branch electromagnetic valve 5 to enter the flat tube micro-channel aluminum-based radiator 6, and then becomes a refrigerant gas having elevated temperature and pressure after absorbing heat therein, to enter the gas-liquid separator 9, another part of the low-temperature and low-pressure refrigerant gas directly enters the gas-liquid separator 9 through the gas suction electromagnetic valve 7, the above two parts of the low-temperature and low-pressure refrigerant gas enter the compressor 1 after mixing. One complete circulation is completed.

In some embodiments, there is provided an air conditioner heat-radiating circulation system, as shown in FIG. 1, which includes a compressor 1, a refrigerating and heating circulation pipeline 25, the compressor 1 outputs a refrigerant gas via a discharge pipe 12, the refrigerant gas flows back to the compressor 1 via a gas suction pipe after circulating in the refrigerating and heating circulation pipeline 2, wherein the gas suction pipe is provided with a refrigerating circulation branch 14, and the refrigerating circulation branch 14 includes a branch electromagnetic valve 5 and a flat tube micro-channel aluminum-based radiator 6 in series as well as a gas suction electromagnetic valve 7 provided on the gas suction pipe, an input terminal 15 of the gas suction electromagnetic valve 7 is connected to an input terminal 16 of the branch electromagnetic valve 5, and an output terminal 18 of the flat tube micro-channel aluminum-based radiator 6 is connected to an output terminal 17 of the gas suction electromagnetic valve 5.

Specifically, the refrigerating and heating circulation pipeline 25 each can includes a four-way reversing valve 2, an outdoor heat exchanger 4 and an indoor heat exchanger 10, wherein the four-way reversing valve 2 has a first interface, a second interface, a third interface and a fourth interface, and communication or cut-off between different interfaces may be electromagnetically controlled; the first interface of the four-way reversing valve 2 is connected to the end of the discharge pipe 12 of the compressor 1, the second interface is connected to one end of the indoor heat exchanger 10 via a first circulation pipeline, the other end of the indoor heat exchanger 10 is connected to one end of the outdoor heat exchanger 4 via a second circulation pipeline, the other end of the outdoor heat exchanger 4 is connected to the fourth interface of the four-way reversing valve 2 via a third circulation pipeline, and the third interface of the four-way reversing valve 2 is connected to the compressor 1 via the gas suction pipe.

The refrigerating circulation branch 14 is provided on the gas suction pipe.

Specifically, the refrigerating circulation branch 14 may include the gas suction electromagnetic valve 7 which is connected in series to the gas suction pipe, and the branch electromagnetic valve 5 and the flat tube micro-channel aluminum-based radiator 6, both of which are connected to sides of the gas suction pipe in parallel, that is, the branch electromagnetic valve 5 and the flat tube micro-channel aluminum-based radiator 6 are connected to each other in series and bridged over the two ends of the gas suction electromagnetic valve 7; wherein, the gas suction electromagnetic valve 7 and the branch electromagnetic valve 6 can receive an electrical signal and adjust opening degrees thereof according to the electrical signal, to control the flow of the refrigerant that flows through the gas suction electromagnetic valve 7 and the branch electromagnetic valve 6.

Preferably, the flat tube micro-channel aluminum-based radiator 6 is further provided with a temperature sensor 8 to detect the ambient temperature; the above system may further include: a main control panel 20 used to control opening degrees of the branch electromagnetic valve 5 and the gas suction electromagnetic valve 7, based on a temperature value measured by the temperature sensor. The main control panel 20 may be an existing chip or circuit board with a processing function; generally, the flat tube micro-channel aluminum-based radiator 6 is installed near the main control panel 20 of the system to cool the main control panel 20, thereby ensuring reliable operation of the main control panel 20 and increasing its service life; correspondingly, the temperature sensor 8 provided on the flat tube micro-channel aluminum-based radiator 6 can efficiently obtain the temperature near the main control panel 20 and feed back the temperature to the main control panel 20. The main control panel 20 determines opening degrees of the gas suction electromagnetic valve 7 and the branch electromagnetic valve 5 corresponding to the above temperature, based on the temperature and also a corresponding relationship between temperature and the opening degrees of the gas suction electromagnetic valve and the branch electromagnetic valve, where the corresponding relationship is preset inside the main control panel 20, so that the refrigerant that returns to the gas suction pipe after circulating in the refrigerating and heating circulation pipeline 25 is divided into two parts at a specific ratio, where one part passes through the gas suction electromagnetic valve 7 and then flows back to the compressor 1, and the other part passes through the branch electromagnetic valve 5 and the flat tube micro-channel aluminum-based radiator 6 and then flows back to the compressor 1; since the amount of the refrigerant that flows through the flat tube micro-channel aluminum-based radiator 6 is determined by measured temperature of the flat tube micro-channel aluminum-based radiator 6, the predetermined cooling effect can be achieved without waste.

A refrigerating process and a heating process will be described below in detail, respectively, with reference to the embodiment as shown in FIG. 1.

When the air conditioner heat-radiating circulation system as shown in this embodiment is used to provide refrigerating effect, the first interface of the four-way reversing valve 2 is controlled to communicate with the fourth interface, the second interface is controlled to communicate with the third interface, and other interfaces are cut-off with each other, in this case, a high-temperature and high-pressure refrigerant gas outputted from the compressor 1 passes through the outdoor heat exchanger 4 and the indoor heat exchanger 10 in sequence and then becomes a low-temperature and low-pressure refrigerant gas, which passes through the second interface and the third interface of the four-way reversing valve 2 and then flows to the gas suction pipe, being divided into two parts, where one part passes through the gas suction electromagnetic valve 7 and the gas-liquid separator 9, and then flows back to the compressor 1, and the other part passes through the branch electromagnetic valve 5, the flat tube micro-channel aluminum-based radiator 6 and the gas-liquid separator 9 in sequence and then flows back to the compressor 1. At this time, due to the high ambient temperature during the refrigerating process, refrigerant through the flat tube micro-channel aluminum-based radiator 6 can have cooling effect on the outside. Furthermore, opening degrees of the gas suction electromagnetic valve 7 and the branch electromagnetic valve 5 here are determined by the main control panel 20 based on the current temperature of the flat tube micro-channel aluminum-based radiator 6, which can ensure predetermined cooling effect of the refrigerant through the flat tube micro-channel aluminum-based radiator 6, causing no unnecessary waste.

When the system needs to provide refrigerating effect, the main control panel 20 is used to control the communications of the first interface with the fourth interface, and the second interface with the third interface, of the four-way reversing valve 2, and other interfaces are cut-off with each other, in this case, a high-temperature and high-pressure refrigerant gas outputted from the compressor 1 passes through the outdoor heat exchanger 4 and the indoor heat exchanger 10 in sequence and then becomes a low-temperature and low-pressure refrigerant gas, which passes through the second interface and the third interface of the four-way reversing valve 2 and then flows to the gas suction pipe, being divided into two parts, where one part passes through the gas suction electromagnetic valve 7 and the gas-liquid separator 9, and then flows back to the compressor 1, and the other part passes through the branch electromagnetic valve 5, the flat tube micro-channel aluminum-based radiator 6 and the gas-liquid separator 9 in sequence and then flows back to the compressor 1. At this time, due to high ambient temperature during the refrigerating process, refrigerant through the flat tube micro-channel aluminum-based radiator 6 can have cooling effect on the outside. Furthermore, opening degrees of the gas suction electromagnetic valve 7 and the branch electromagnetic valve 5 here are determined by the main control panel 20 based on the current temperature of the flat tube micro-channel aluminum-based radiator 6, which can ensure predetermined cooling effect of the refrigerant through the flat tube micro-channel aluminum-based radiator 6, causing no unnecessary waste.

When the air conditioner heat-radiating circulation system provided in this embodiment needs to provide heating effect (e.g. in winter), the first interface of the four-way reversing valve 2 is controlled to communicate with the second interface, the third interface is controlled to communicate with the fourth interface, and other interfaces are cut-off with each other, in this case, a high-temperature and high-pressure refrigerant gas outputted from the compressor 1 passes through the indoor heat exchanger 10 and the outdoor heat exchanger 4 in sequence and then becomes a low-temperature and low-pressure refrigerant gas, which passes through the fourth interface and the third interface of the four-way reversing valve 2 and then flows to the gas suction pipe, being divided into two parts, where one part passes through the gas suction electromagnetic valve 7 and the gas-liquid separator 9, and then flows back to the compressor 1, and the other part passes through the branch electromagnetic valve 5, the flat tube micro-channel aluminum-based radiator 6 and the gas-liquid separator 9 in sequence and then flows back to the compressor 1. At this time, due to low ambient temperature during the heating process, refrigerant through the flat tube micro-channel aluminum-based radiator 6 can absorb heat emitted from the main control panel 20 and the like and bring the heat back to the compressor, in addition to have cooling effect on the outside, thereby achieving the recycling of heat and saving of energy.

The air conditioner heat-radiating circulation system provided in this embodiment, which provides the refrigerating circulation branch 14 on the gas suction pipe, with the refrigerating circulation branch 14 including the branch electromagnetic valve and the flat tube micro-channel aluminum-based radiator in series as well as the gas suction electromagnetic valve provided on the gas suction pipe, can achieve division of refrigerant as desired, thereby controlling a part of the refrigerant in a desired amount flows through flat tube micro-channel aluminum-based radiator, to achieve cooling of the main control panel 20, and the remaining of the refrigerant normally flows back to the compressor, to ensure that the main control panel 20 does not have too high operating temperature and to avoid waste of the refrigerant; meanwhile, since the refrigerant can bring heat that is absorbed during the refrigerant flows back to the compressor to the compressor, the system can achieve recycling of heat when used to provide heating effect, thereby improving work efficiency and saving energy.

Finally, it should be appreciated that the above embodiments are only used to illustrate technical solutions of the present invention, but not intended to limit thereto; although the present invention has been described in detail with reference to the foregoing embodiments, those ordinary skilled in the art should understand that, many modifications to each of the technical solutions described in the foregoing embodiments, or equivalent replacements to some or all of the technical features in the technical solutions are possible; such modifications or replacements do not make the essence of corresponding technical solutions depart from the scope of the technical solutions of the embodiments of the present invention.

What is claimed is:

1. An air conditioner heat-radiating circulation system, comprising a compressor, a discharge pipe, a refrigerating and heating circulation pipeline, a gas suction pipe, and a four-way reversing valve having a first interface, a second interface, a third interface and a fourth interface, wherein the compressor is configured to output refrigerant gas via the discharge pipe to the four-way reversing valve and the four-way reversing valve is configured to receive the refrigerant gas outputted by the compressor and then output the refrigerant gas into the refrigerating and heating circulation pipeline and is configured to receive the refrigerant gas after circulating in the refrigerating and heating circulation pipeline and then output, through the third interface thereof, the refrigerant gas to the compressor via the gas suction pipe, wherein, when in a cooling mode, the four-way reversing valve is configured to receive, through the first interface thereof, the refrigerant gas outputted by the compressor and output, through the fourth interface thereof, the refrigerant gas into the refrigerating and heating circulation pipeline, and then receive, through the second interface thereof, the refrigerant gas after circulating in the refrigerating and heating circulation pipeline and output, through the third interface thereof, the refrigerant gas to the compressor via the gas suction pipe;

when in a heating mode, the four-way reversing valve is configured to receive, through the first interface thereof, the refrigerant gas outputted by the compressor and output, through the second interface thereof, the refrigerant gas into the refrigerating and heating circulation pipeline, and then receive, through the fourth interface thereof, the refrigerant gas after circulating in the refrigerating and heating circulation pipeline and output, through the third interface thereof, the refrigerant gas to the compressor via the gas suction pipe;

wherein the gas suction pipe comprises a refrigerating circulation branch and another branch, the refrigerating circulation branch comprises a branch electromagnetic valve and a flat tube micro-channel aluminum-based radiator in series and the another branch comprises a gas suction electromagnetic valve and is connected with the refrigerating circulation branch in parallel, the third interface of the four-way reversing valve is connected to an input end of the gas suction electromagnetic valve and the branch electromagnetic valve, and an output terminal of the flat tube micro-channel aluminum-based radiator and an output terminal of the gas suction electromagnetic valve are connected to an input terminal of the compressor so that the gas suction pipe is located downstream of the third interface of the four-way reversing valve and upstream of the compressor.

2. The air conditioner heat-radiating circulation system according to claim 1, wherein an indoor heat exchanger and an outdoor heat exchanger are connected in the refrigerating and heating circulation pipeline in series, and the four-way reversing valve has a fluid communication configuration for the cooling mode and a fluid communication configuration for the heating mode;

wherein, in the cooling mode, the four-way reversing valve is configured to be switched to the fluid communication configuration for the cooling mode, so that the refrigerant gas outputted by the compressor is first inputted into the outdoor heat exchanger and, then, flows through the indoor heat exchanger; and wherein, in the heating mode, the four-way reversing valve is configured to be switched to the fluid communication configuration for the heating mode, so that the refrigerant gas outputted by the compressor is first inputted into the indoor heat exchanger and, then, flows through the outdoor heat exchanger.

3. The air conditioner heat-radiating circulation system according to claim 1, comprising a variable-frequency compressor driver and a variable-frequency blower driver, wherein the flat tube micro-channel aluminum-based radiator is positioned adjacent to the variable-frequency compressor driver and the variable-frequency blower driver so as to absorb heat emitted from the variable-frequency compressor driver and the variable-frequency blower driver.

4. The air conditioner heat-radiating circulation system according to claim 1, wherein the flat tube micro-channel aluminum-based radiator is fixed on an electric box via a fixing bracket.

5. The air conditioner heat-radiating circulation system according to claim 1, wherein a temperature sensor is installed on the flat tube micro-channel aluminum-based radiator.

6. The air conditioner heat-radiating circulation system according to claim 5, further comprising: a main control panel electrically connected to the temperature sensor so as to control opening degrees of the branch electromagnetic valve and the gas suction electromagnetic valve, based on a temperature value measured by the temperature sensor.

7. The air conditioner heat-radiating circulation system according to claim 5, comprising a variable-frequency compressor driver and a variable-frequency blower driver, the flat tube micro-channel aluminum-based radiator is positioned adjacent to the variable-frequency compressor driver and the variable-frequency blower driver so as to absorb heat emitted from the variable-frequency compressor driver and the variable-frequency blower driver.

8. The air conditioner heat-radiating circulation system according to claim 5, wherein the flat tube micro-channel aluminum-based radiator is fixed on an electric box via a fixing bracket.

9. The air conditioner heat-radiating circulation system according to claim 6, comprising a variable-frequency compressor driver and a variable-frequency blower driver, the flat tube micro-channel aluminum-based radiator is positioned adjacent to the variable-frequency compressor driver and the variable-frequency blower driver so as to absorb heat emitted from the variable-frequency compressor driver and the variable-frequency blower driver.

10. The air conditioner heat-radiating circulation system according to claim 6, wherein the flat tube micro-channel aluminum-based radiator is fixed on an electric box via a fixing bracket.

11. An air conditioner heat-radiating circulation system, comprising a compressor, a four-way reversing valve having a first interface, a second interface, a third interface and a fourth interface, an outdoor heat exchanger, and an indoor heat exchanger, wherein the compressor has a discharge pipe connected to the first interface of the four-way reversing valve, the fourth interface of the four-way reversing valve is connected to a first end of the outdoor heat exchanger, a second end of the outdoor heat exchanger is connected to a first end of the indoor heat exchanger via an electronic expansion valve, a second end of the indoor heat exchanger is connected to the second interface of the four-way reversing valve, the third interface of the four-way reversing valve is connected to an input end of a gas suction pipe, and an output end of the gas suction pipe is connected to the compressor via a gas-liquid separator, wherein the gas suction pipe comprises a refrigerating circulation branch and another branch, the another branch comprises a gas suction electromagnetic valve and is connected with the refrigerating circulation branch in parallel, the refrigerating circulation branch comprises a branch electromagnetic valve and a flat tube micro-channel aluminum-based radiator in series, and the flat tube micro-channel aluminum-based radiator has a temperature sensor, the gas suction pipe is located downstream of the third interface of the four-way reversing valve and upstream of the compressor;

wherein the four-way reversing valve has a fluid communication configuration for a cooling mode and a fluid communication configuration for a heating mode, when the air conditioner heat-radiating circulation system is configured to be operated in the heating mode, the first interface and the second interface of the four-way reversing valve are in fluid communication and the fourth interface and the third interface of the four-way reversing valve are in fluid communication, so that refrigerant gas outputted by the compressor is introduced into the indoor heat exchanger via the first interface and the second interface and, after sequentially passing through the indoor heat exchanger and the outdoor heat exchanger, is circulated back to the compressor via the fourth interface, the third interface and the gas suction pipe; and when the air conditioner heat-radiating circulation system is configured to be operated in the cooling mode, the first interface and the fourth interface of the four-way reversing valve are in fluid communication and the second interface and the third interface of the four-way reversing valve are in fluid communication, so that refrigerant gas outputted by the compressor is introduced into the outdoor heat exchanger via the first interface and the fourth interface and, after sequentially passing through the outdoor heat exchanger and the indoor heat exchanger, is circulated back to the compressor via the second interface, the third interface and the gas suction pipe.

12. The air conditioner heat-radiating circulation system according to claim 10, wherein a stop valve is disposed between the second end of the indoor heat exchanger and the second interface of the four-way reversing valve.

13. The air conditioner heat-radiating circulation system according to claim 11, wherein the flat tube micro-channel aluminum-based radiator is fixed on an electric box via a fixing bracket.

14. The air conditioner heat-radiating circulation system according to claim 11, comprising a variable-frequency compressor driver and a variable-frequency blower driver, wherein the flat tube micro-channel aluminum-based radiator is positioned adjacent to the variable-frequency compressor driver and the variable-frequency blower driver so as to absorb heat emitted from the variable-frequency compressor driver and the variable-frequency blower driver.

15. The air conditioner heat-radiating circulation system according to claim 14, wherein the flat tube micro-channel aluminum-based radiator is fixed on an electric box via a fixing bracket.

16. The air conditioner heat-radiating circulation system according to claim 11, wherein the temperature sensor is configured to control opening degrees of the branch electromagnetic valve and the gas suction electromagnetic valve.

17. The air conditioner heat-radiating circulation system according to claim 16, wherein the flat tube micro-channel aluminum-based radiator is fixed on an electric box via a fixing bracket.

* * * * *